US010888163B2

(12) United States Patent
Cook

(10) Patent No.: US 10,888,163 B2
(45) Date of Patent: Jan. 12, 2021

(54) FOLDABLE GLIDER CHAIR

(71) Applicant: Westfield Outdoor, Inc., Indianapolis, IN (US)

(72) Inventor: Jordan Cook, Indianapolis, IN (US)

(73) Assignee: Westfield Outdoor, Inc., Indianapolis, IN (US)

( * ) Notice: Subject to any disclaimer, the term of this patent is extended or adjusted under 35 U.S.C. 154(b) by 112 days.

(21) Appl. No.: 16/440,467

(22) Filed: Jun. 13, 2019

(65) Prior Publication Data

US 2020/0015590 A1 Jan. 16, 2020

Related U.S. Application Data

(60) Provisional application No. 62/696,495, filed on Jul. 11, 2018.

(51) Int. Cl.

| | |
|---|---|
| ***A47C 3/025*** | (2006.01) |
| ***A47C 4/28*** | (2006.01) |
| *A47C 7/70* | (2006.01) |

(52) U.S. Cl.
CPC ..... *A47C 3/0255* (2013.01); *A47C 4/283* (2013.01); *A47C 7/70* (2013.01)

(58) Field of Classification Search
CPC ..... A47C 3/0255; A47C 4/283; A47C 4/045; A47C 7/70; A47C 7/40
USPC ..... 297/259.3, 281
See application file for complete search history.

(56) References Cited

U.S. PATENT DOCUMENTS

| | | | | |
|---|---|---|---|---|
| 2,611,419 | A * | 9/1952 | McKinney | A47C 3/0255 297/81 |
| 2,646,838 | A | 7/1953 | Welsh | |
| 2,758,634 | A | 8/1956 | Welsh et al. | |
| 3,414,325 | A * | 12/1968 | Jutila | A47C 3/0255 297/281 |
| 7,322,650 | B2 | 1/2008 | Chouinard et al. | |
| 2010/0171342 | A1* | 7/2010 | Chen | A47C 4/283 297/45 |
| 2013/0106145 | A1* | 5/2013 | Chen | A47C 4/283 297/42 |
| 2015/0082526 | A1* | 3/2015 | Grudzinski | A47K 11/04 4/239 |
| 2016/0206101 | A1* | 7/2016 | Grace | A47C 4/16 |

FOREIGN PATENT DOCUMENTS

| | | | | |
|---|---|---|---|---|
| DE | 29921829 U1 * | 2/2000 | | A47C 4/283 |
| GB | 158988 A * | 2/1921 | | A47C 3/0255 |

* cited by examiner

*Primary Examiner* — Milton Nelson, Jr.
(74) *Attorney, Agent, or Firm* — Thompson Coburn LLP; Matthew J. Himich

(57) ABSTRACT

A foldable glider chair has a base and gliding seat frame pivotally connected to the base to allow relative movement of the gliding seat frame relative to the base in a reciprocating fashion in a direction parallel to the width edges of the seat. The base and gliding seat frame are foldable in tandem.

26 Claims, 12 Drawing Sheets

FOLDABLE GLIDER CHAIR

RELATED APPLICATION DATA

This application claims the benefit of U.S. provisional application Ser. No. 62/696,495, filed Jul. 11, 2018, the disclosure of which is incorporated by reference herein.

BACKGROUND AND SUMMARY

The present disclosure is directed to a foldable glider chair. The glider chair has a base and gliding seat frame pivotally connected to the base to allow relative movement of the gliding seat frame relative to the base in a reciprocating fashion in a direction parallel to the width edges of the seat.

DESCRIPTION

Figure 3:
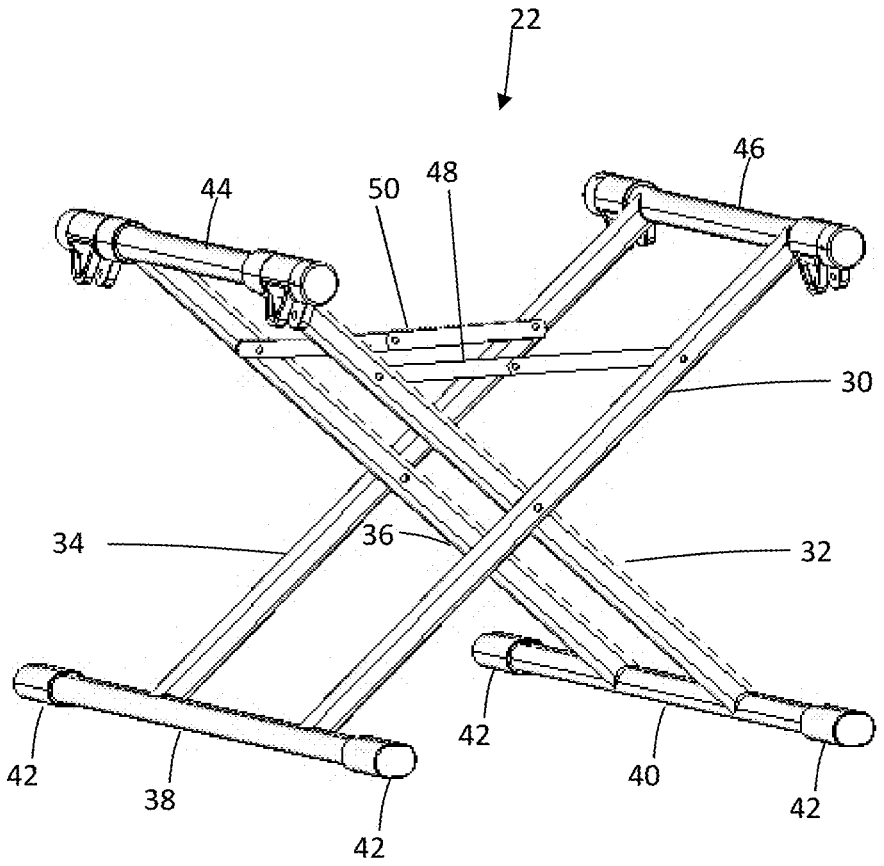
FIG. 3 is a perspective view of an exemplary base of the glider chair of FIG. 1.
Figure 4:
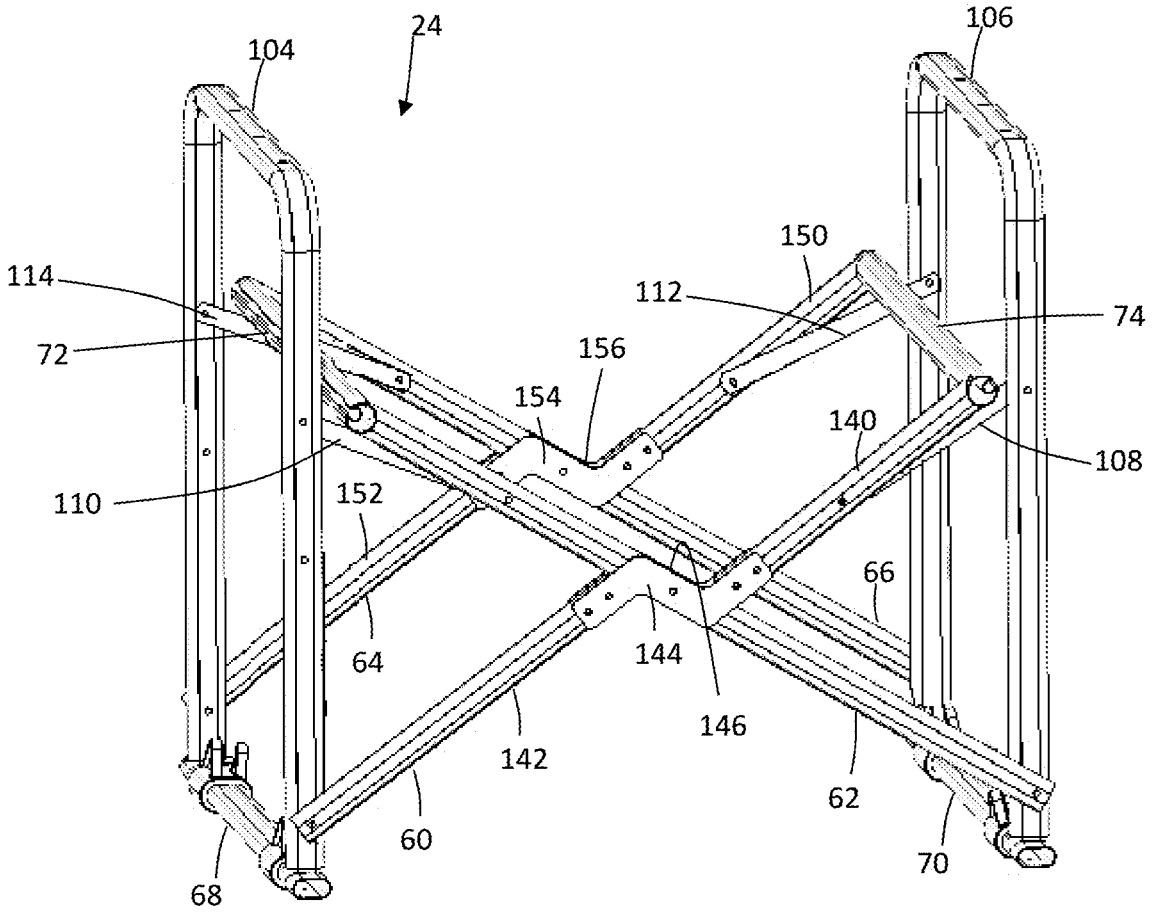
FIG. 4 is a perspective view of an exemplary gliding seat frame of the glider chair of FIG. 1.
Figure 5:
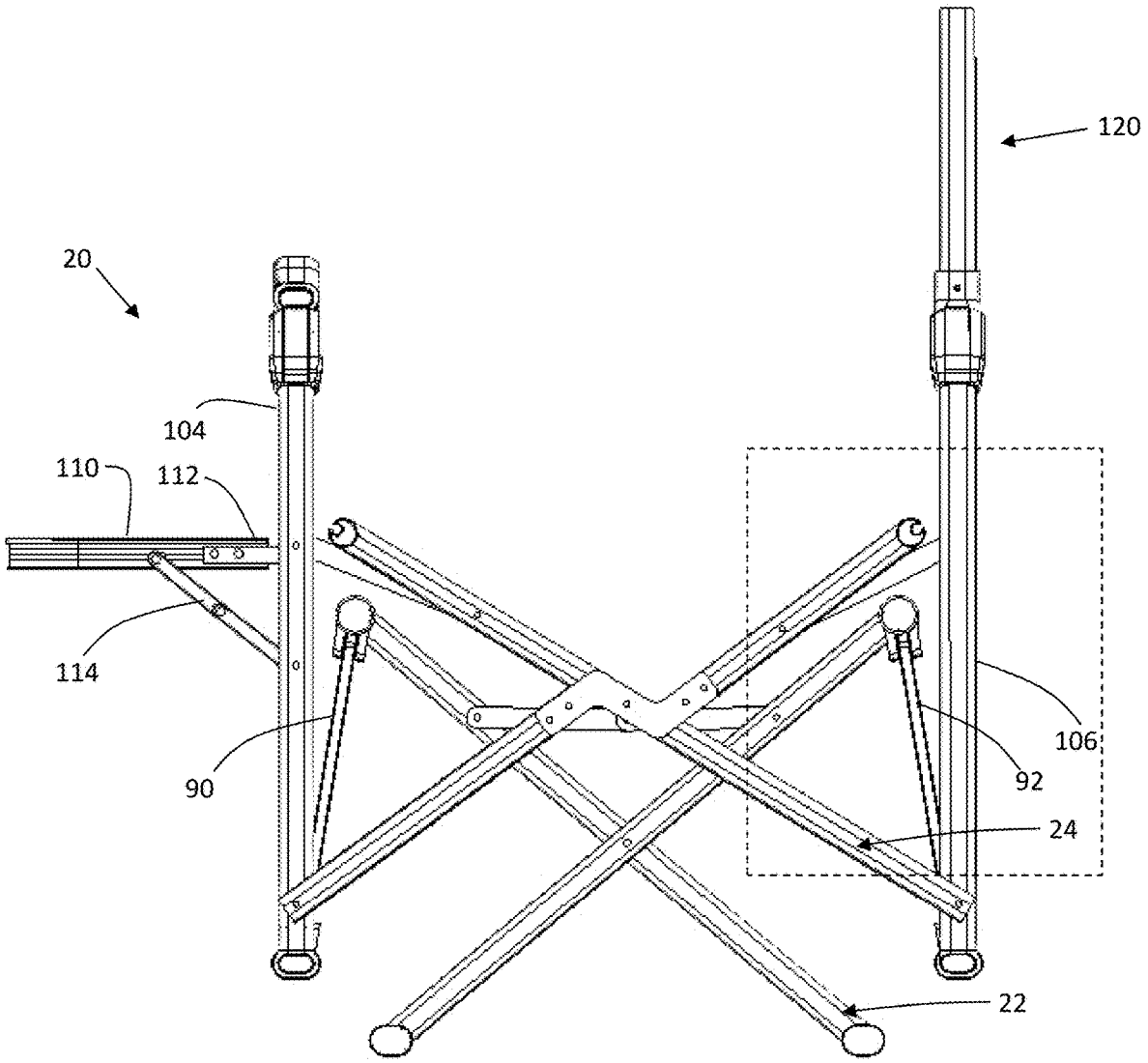
FIG. 5 is a front elevational view of the glider chair of FIG. 1.
Figure 6:
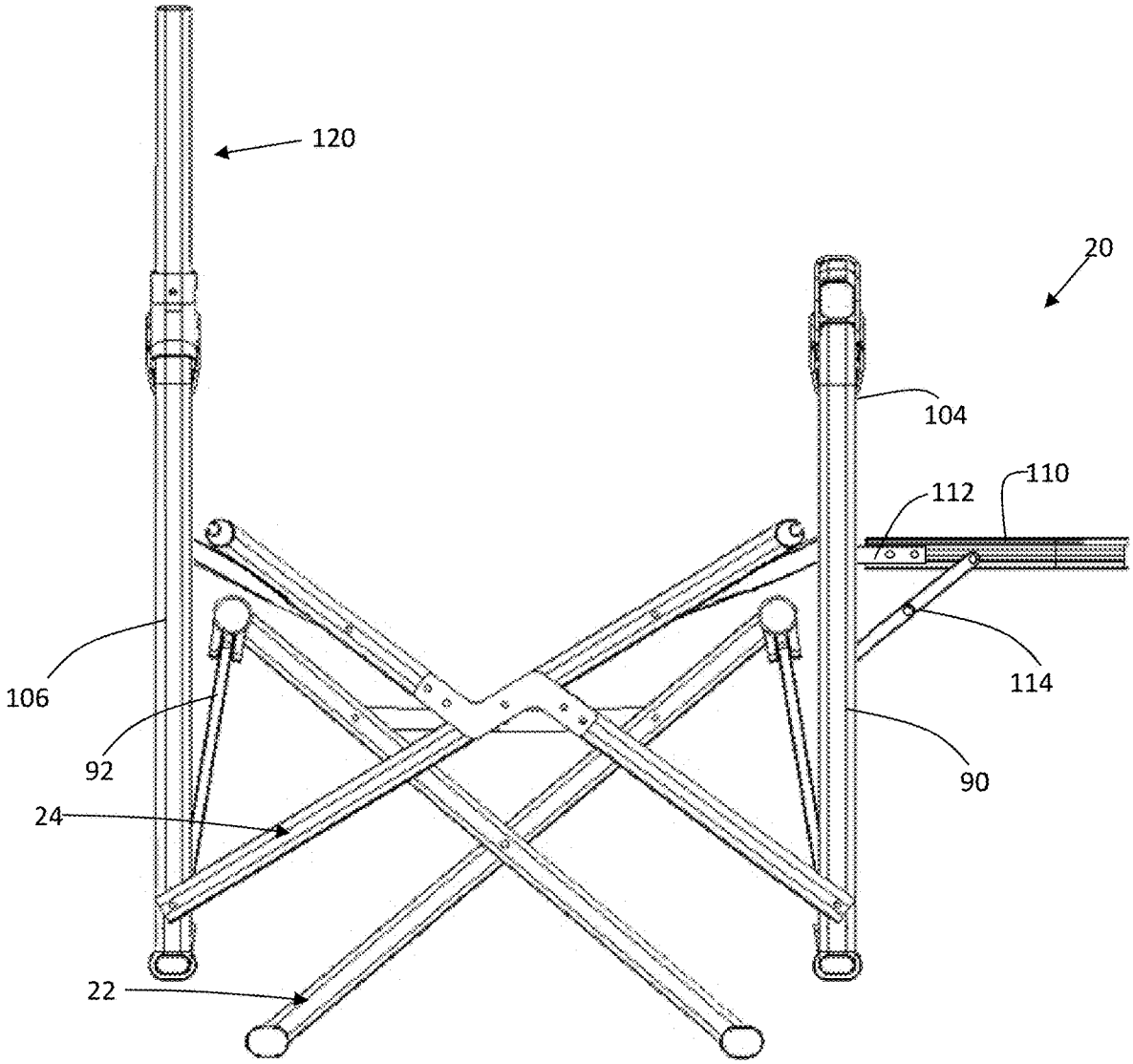
FIG. 6 is a rear elevational view of the glider chair of FIG. 5.
Figure 7:
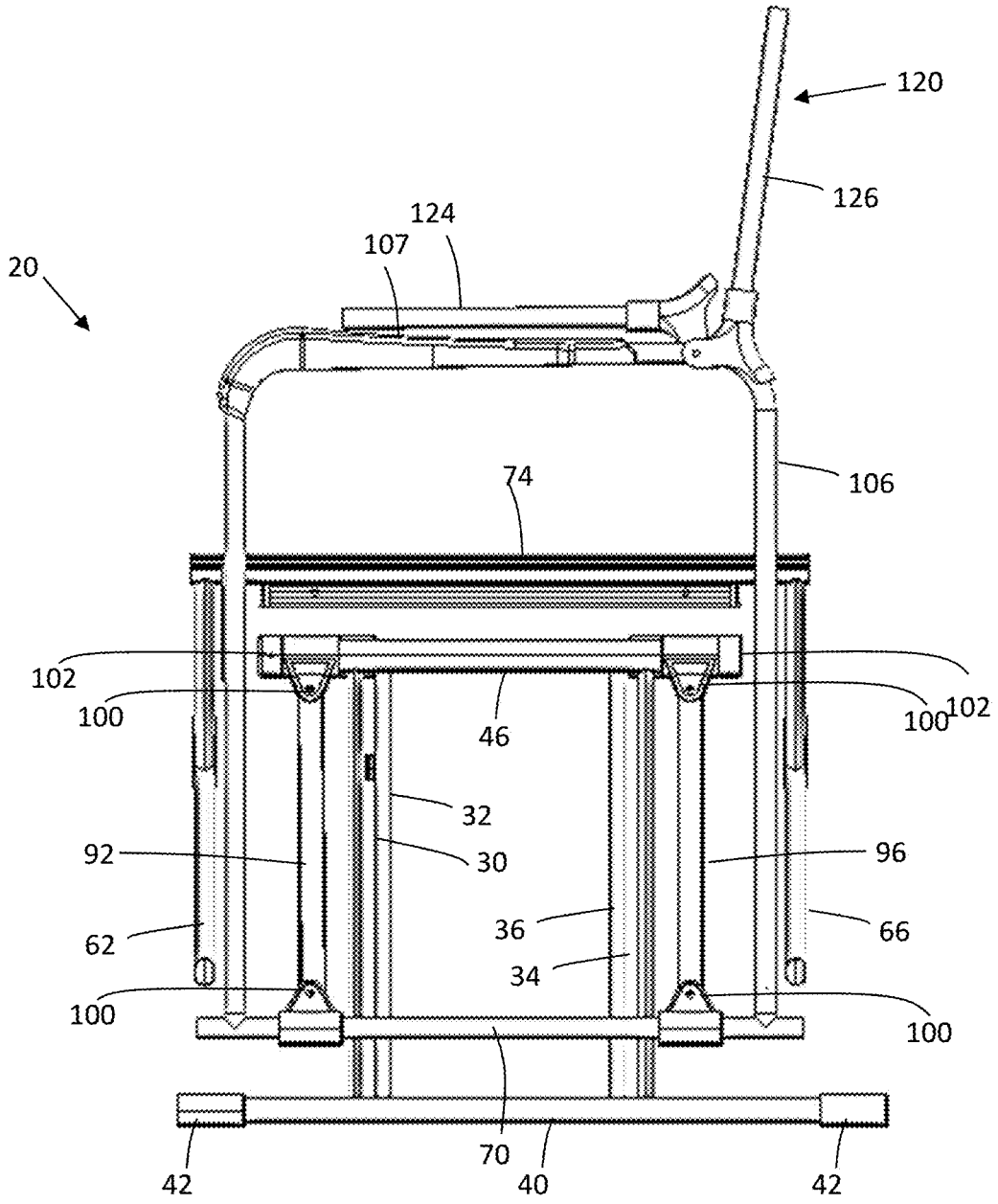
FIG. 7 is a right side view of the glider chair of FIG. 5.
Figure 8:
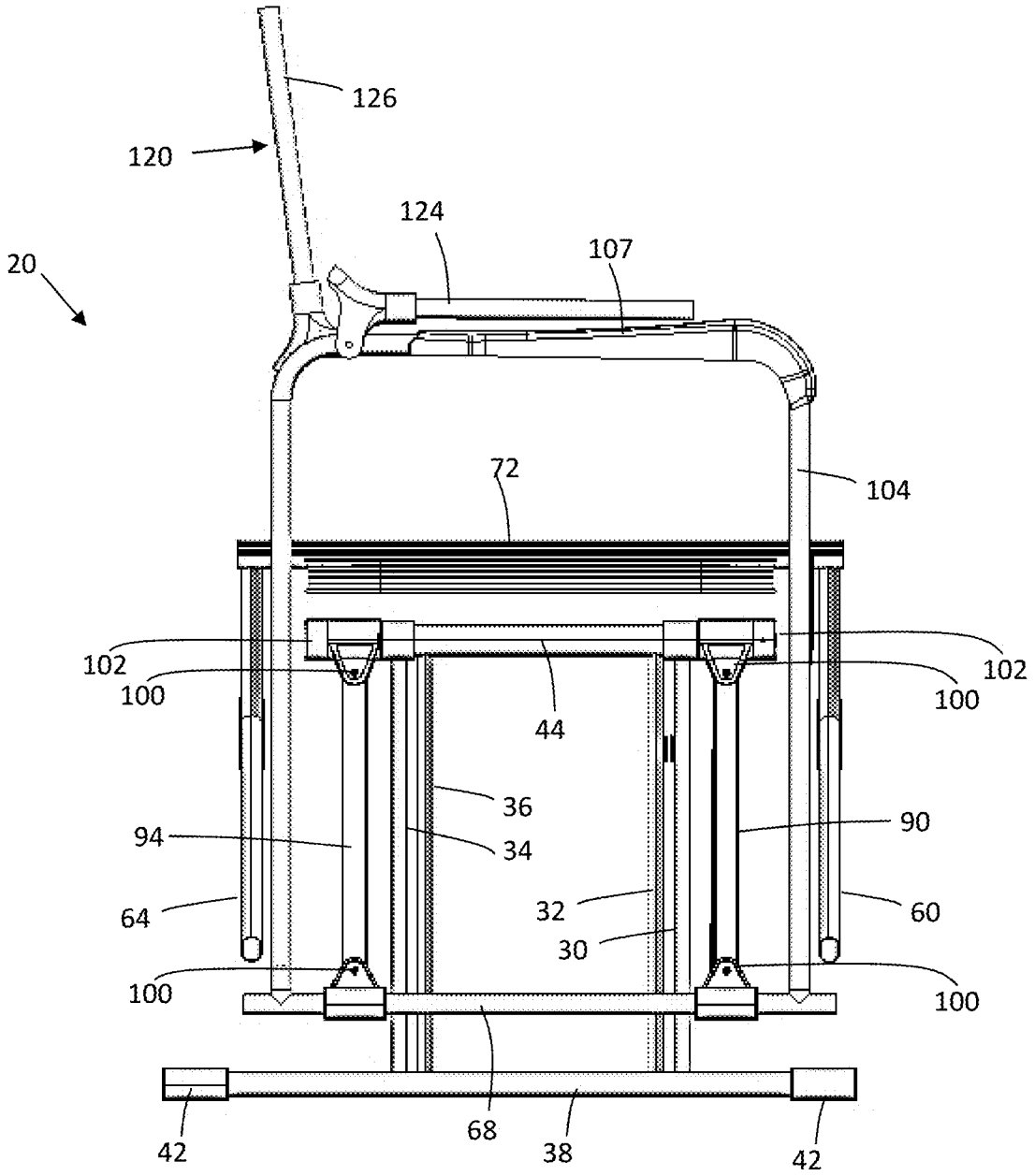
FIG. 8 is a left side view of the glider chair of FIG. 5.

An exemplary foldable glider chair has a base 22 and a gliding seat frame 24. The construction of the base 22 is best shown in FIG. 3. The construction of the gliding seat frame 24 is best shown in FIG. 4. The gliding seat frame 24 is operatively pivotally connected to the base 24 so as to provide gliding action of the gliding seat frame relative to the base. Both the gliding seat frame 24 and the base 22 may be moved between expanded and collapsed positions in tandem so as to provide a foldable glider chair.

The base 22 may have first and second front leg supports 30,32 and first and second rear leg supports 34,36. The first and second front leg supports 30,32 may be arranged as front cross leg supports. The first and second rear leg supports 34,36 may be arranged as rear cross leg supports. The first front leg support 30 may be pivotally connected to the second front leg support 32. The first rear leg support 34 may be pivotally connected to the second rear leg support 36. The first front leg support 30 and the first rear leg 34 support may be connected to a first lower leg support 38. The second front leg support 34 and second rear leg support 36 may be connected to a second lower leg support 40. The first and second lower leg supports may be configured to support the glider chair on a support surface, and may have support feet 42 to assist in providing a level structure for the glider chair. The first front leg support 30 and the first rear leg support 34 may be connected to a first upper leg support 44. The second front leg support 32 and second rear leg support 36 may be connected to a second upper leg support 46. The front cross leg supports may be spaced from the rear cross supports by the first and second lower leg supports 38,40 and the first and second upper leg supports 44,46. The first and second lower leg supports 38,40 and the first and second upper leg supports 44,46 may define a direction parallel to the direction of gliding as will become evident from the discussion that follows.

The front cross leg supports 30,32 and the rear cross leg supports 34,36 may be movable between an expanded position and a collapsed position. In the expanded position, the first lower leg support 38 is spaced from the second lower leg support 40 at a first distance. In the collapsed position the first lower leg support 38 is spaced from the second lower leg support 40 at a second distance where the second distance is less than the first distance. In the expanded position, the first upper leg support 44 and the second upper leg support 46 may be spaced apart a first distance. In the collapsed position, the first upper leg support 44 and the second upper leg support 46 may be spaced apart a second distance which is less than the first distance. In the collapsed position, the first upper leg support 44 may be adjacent to the second upper leg support 46. In the collapsed position, the first lower leg support 38 may be adjacent to the second lower leg support 40.

To maintain the first and second front leg supports in the expanded position, a front over center pivot linkage 48 (not shown in FIG. 3 for ease of illustration) may be provided between the first and second cross leg supports 30,32. The front over center linkage 48 may be folded to move the base from the expanded position to the collapsed position and may be extended to move the base from the collapsed position to the expanded position. In addition, or alternative, to maintain the first and second rear cross leg supports 34,36 in the expanded position, a rear over center pivot linkage 50 (not shown in FIG. 3 for ease of illustration) may be provided between the first and second rear leg supports. The rear over center linkage 50 may be folded to move the base from the expanded position to the collapsed position and may be extended to move the base from the collapsed position to the expanded position. Pivot connections, for instance, through a pin, may be provided to rotationally secure the over center linkages with the leg supports 30,32, 34,36.

Figure 9:
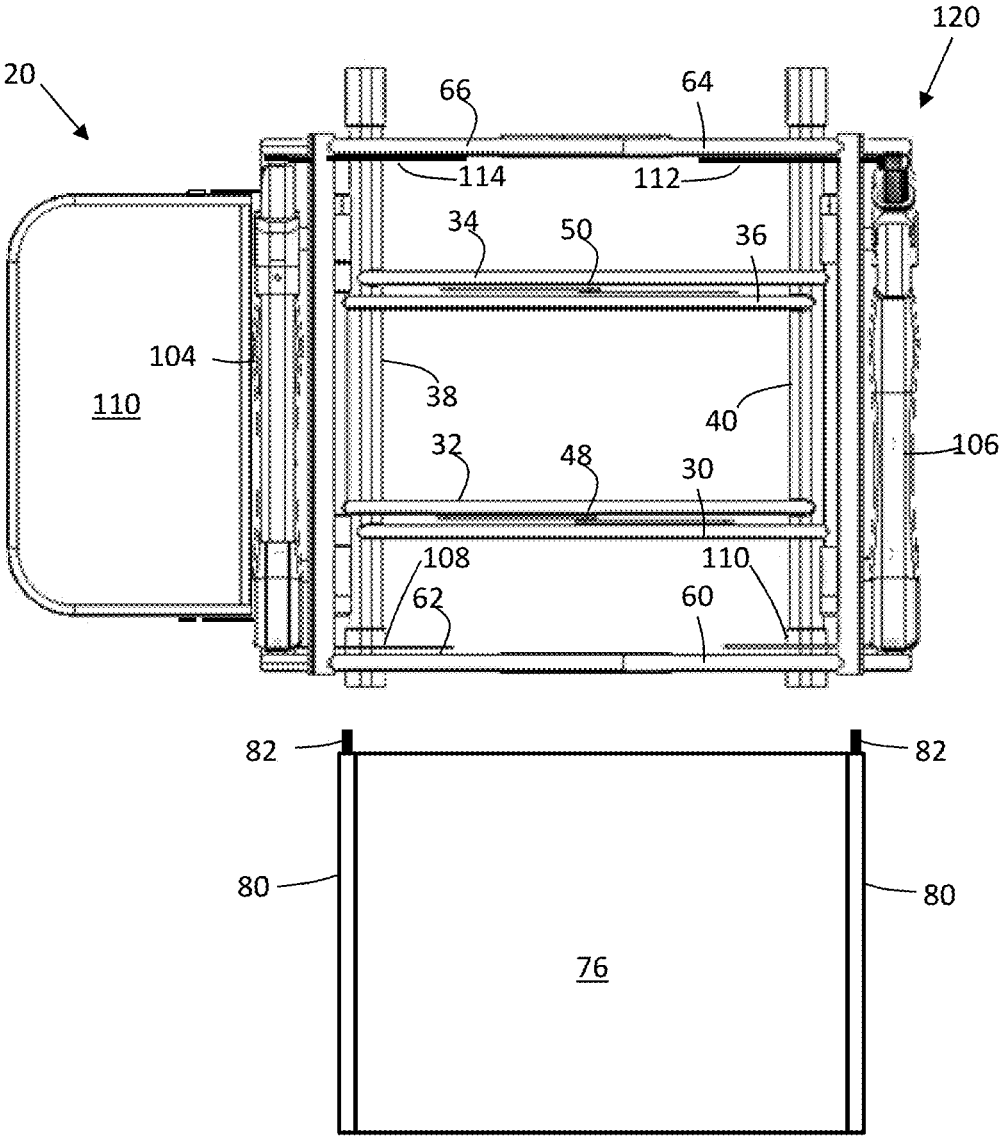
FIG. 9 is a top plan view of the glider chair of FIG. 5.
Figure 10:
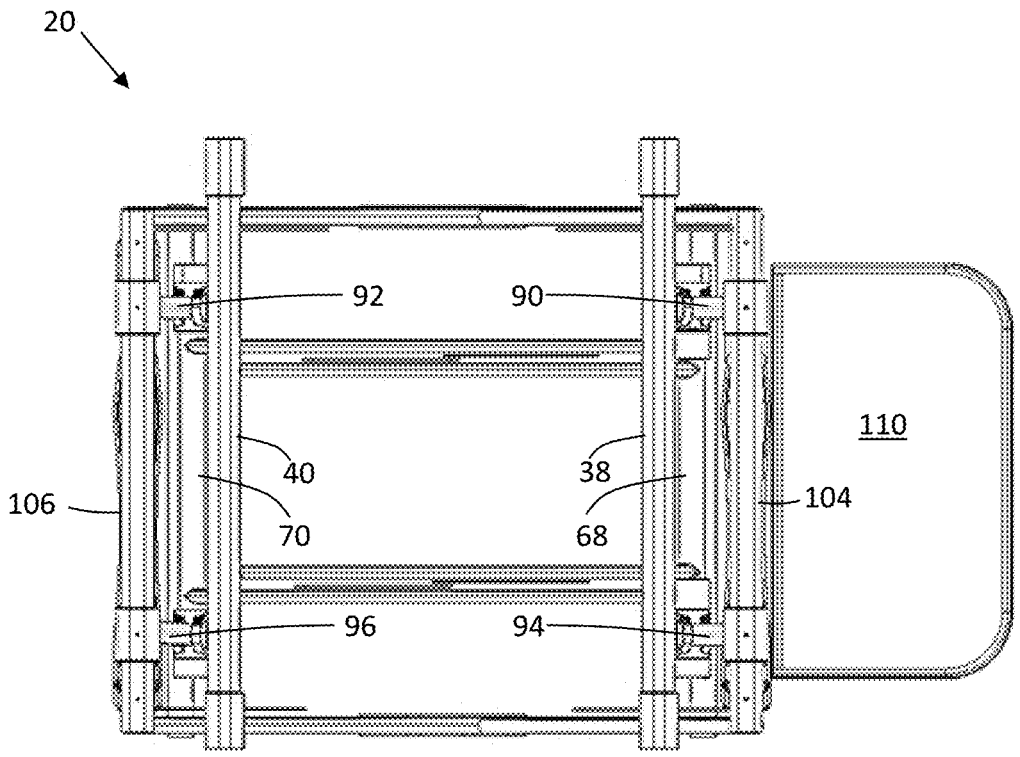
FIG. 10 is a bottom view of the glider chair of FIG. 5.
Figure 11:
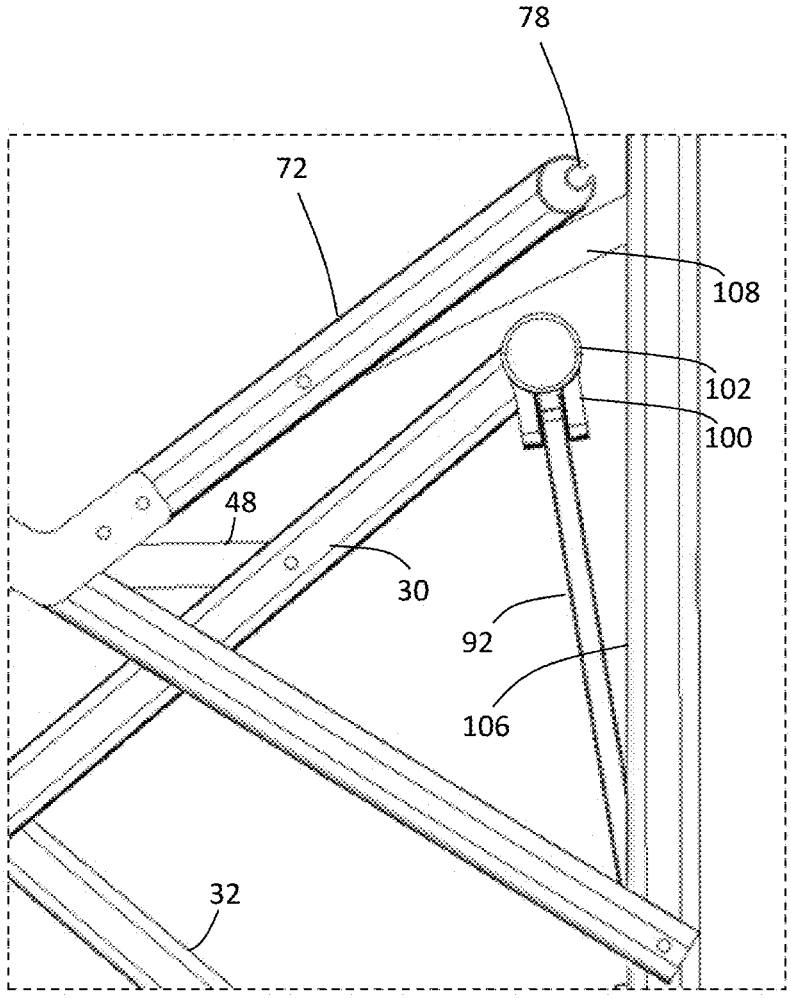
FIG. 11 is a partial enlarged view of detail area 11 of FIG. 5.
Figure 12:
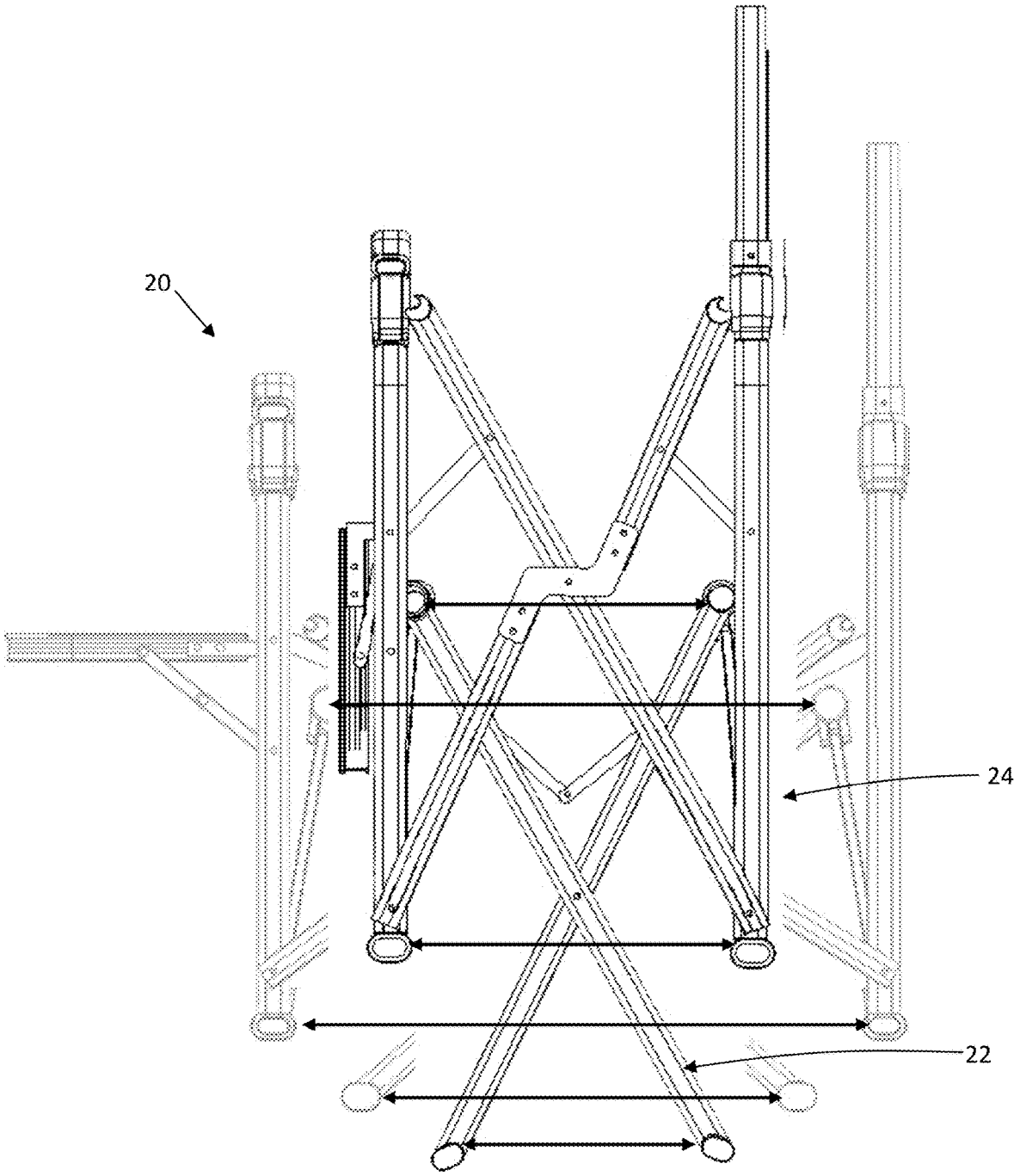
FIG. 12 is front elevational view of the glider chair of FIG. 5 in a collapsed position.

The gliding seat frame 24 may have front cross seat supports and rear cross seat supports. The gliding frame front cross seat supports may include first and second front seat supports 60,62, and the rear cross seat supports may include first and second rear seat supports 64,66. The first front seat support 60 may be operatively pivotally connected to the second front seat support 62. The first rear seat support 64 may be operatively pivotally connected to the second rear seat support 66. The front cross seat supports may be spaced from the rear cross supports by first and second lower seat supports 68,70 and first and second upper seat supports 72,74. The first and second upper seat supports 72,74 may be configured to support a seat 76 (FIG. 9) of the glider chair. In that regard, the first and second upper seat supports 72,74 may have a groove 78 (FIG. 11) to receive a pliant material forming the seat portion 76 of the seat. The pliant material forming the seat portion 76 of the seat may have sleeves 80 formed on its margins to receive a dowel 82, and the dowel and the sleeve may be fitted into the groove 78 of the first and second upper seat supports 72,74. The first front seat support 60 and the first rear seat support 64 may be operatively connected to the first lower seat support 68, and the second front seat support 62 and second rear seat support may be operatively connected to a second lower seat support 70, as will be explained below.

The front cross seat supports 60,62 and the rear cross seat supports 64,66 may be movable between an expanded position and a collapsed position. In the expanded position, the first lower seat support 68 is spaced from the second lower leg support 70 at a third distance. In the collapsed position the first lower seat support 68 is spaced from the second lower seat support 70 at a fourth distance where the fourth distance is less than the third distance. In the expanded position, the first upper seat support 72 is spaced from the second upper seat support 74 at a third distance. In the collapsed position the first upper seat support 72 is spaced from the second upper seat support 74 at a fourth distance where the fourth distance is less than the third distance. In the collapsed position, the first upper seat support 72 may be adjacent to the second upper seat support 74. In the collapsed position, the first lower seat support 68 may be adjacent to the second lower seat support 70.

The glider chair may be provided with glide struts 90,92, 94,96 extending between the base and gliding seat frames 22,24. A first glide strut 90 may be provided between the first lower seat support 68 and the first upper leg support 44. The first glide strut 90 may be operatively pivotally connected to both the first lower seat support 68 and the first upper leg support 44. A second glide strut 92 may be provided between the second lower seat support 70 and the second upper leg support 46. The second glide strut 92 may be operatively pivotally connected to both the second lower seat support 68 and the second upper leg support 46. A third glide 94 strut may be provided between the first lower seat support 68 and the first upper leg support 44. The third glide strut 94 may be operatively pivotally connected to both the first lower seat support 68 and the first upper leg support 44. A fourth glide strut 96 may be provided between the second lower seat support 70 and the second upper leg support 46. The fourth glide strut 96 may be operatively pivotally connected to both the second lower seat support 70 and the second upper leg support 46. The first and third glide struts 90,94 may be arranged as a first front glide strut and a first rear glide strut. The second and fourth glide struts 92,96 may be arranged as a second front glide strut and a second rear glide strut. Thus, the first lower seat support 68 and first upper leg support 44 may be pivotally connected to the first front glide strut 90 and the first rear glide strut 94, and the second lower seat 70 support and second upper leg support 46 may be pivotally connected to the second front glide strut 92 and the second rear glide strut 96. Pivot joints 100 fixed in position on the first and second upper leg supports 44,46 and the first and second lower seat supports 68,70 may provide the pivot connections for the glide struts 90,92,94,96. The pivot joints 100 may be fixed in position on the first and second upper leg seat supports and the first and second lower seat supports with locking collars 102. While the drawings show front and rear first glide struts and front and rear second glide struts, one or more glide struts may be provided on each side of the chair.

The gliding seat frame may include first and second arm rest members 104,106. The first arm rest member 104 may comprise a U-shaped member and may be connected to the first lower seat support 68. The second arm rest member 106 may comprise a U-shaped member and may be connected to the second lower seat support 70. The first front seat support 60 and the first rear seat support 64 may be operatively connected to the first lower seat support 68 through the first arm rest member 104. The second front seat support 62 and the second rear seat support 66 may be operatively connected to the second lower seat support 70 through the second arm rest member 106. Pivot connections, for instance, through a pin, may be provided to rotationally secure the seat supports 60,62,64,66 with the arm rest members 104,106. Arm engaging portions 107 may be provided on the horizontal portions of the first and second arm rest members 104,106.

The first front seat support 60 may be connected to second arm rest member 106 with a first front arm rest support linkage 108, and the second front seat support 62 may be connected to the first arm rest member 104 with a second front arm rest support linkage 110. The first rear seat support 64 may be connected to second arm rest member 106 with a first rear arm rest support linkage 112, and the second front rear seat support 66 may be connected to the first arm rest member 104 with a second rear arm rest support linkage 114. Pivot connections, for instance, through a pin, may be provided to rotationally secure the linkages 108,110,112,114 to their respective connections with the arm rest members 104,106, and the seat supports 60,62,64,66.

The gliding chair may include a tray 110 pivotally connected to at least one of the first and second arm rest members 104,106. One or more hinges 112 and over center linkages 114 may be provided between the arm rest 104,106 and the tray 110 to allow the tray to pivot to a collapsed position relative to the arm rest and an extended position in which the tray projects perpendicularly from the arm rest.

Figure 1:
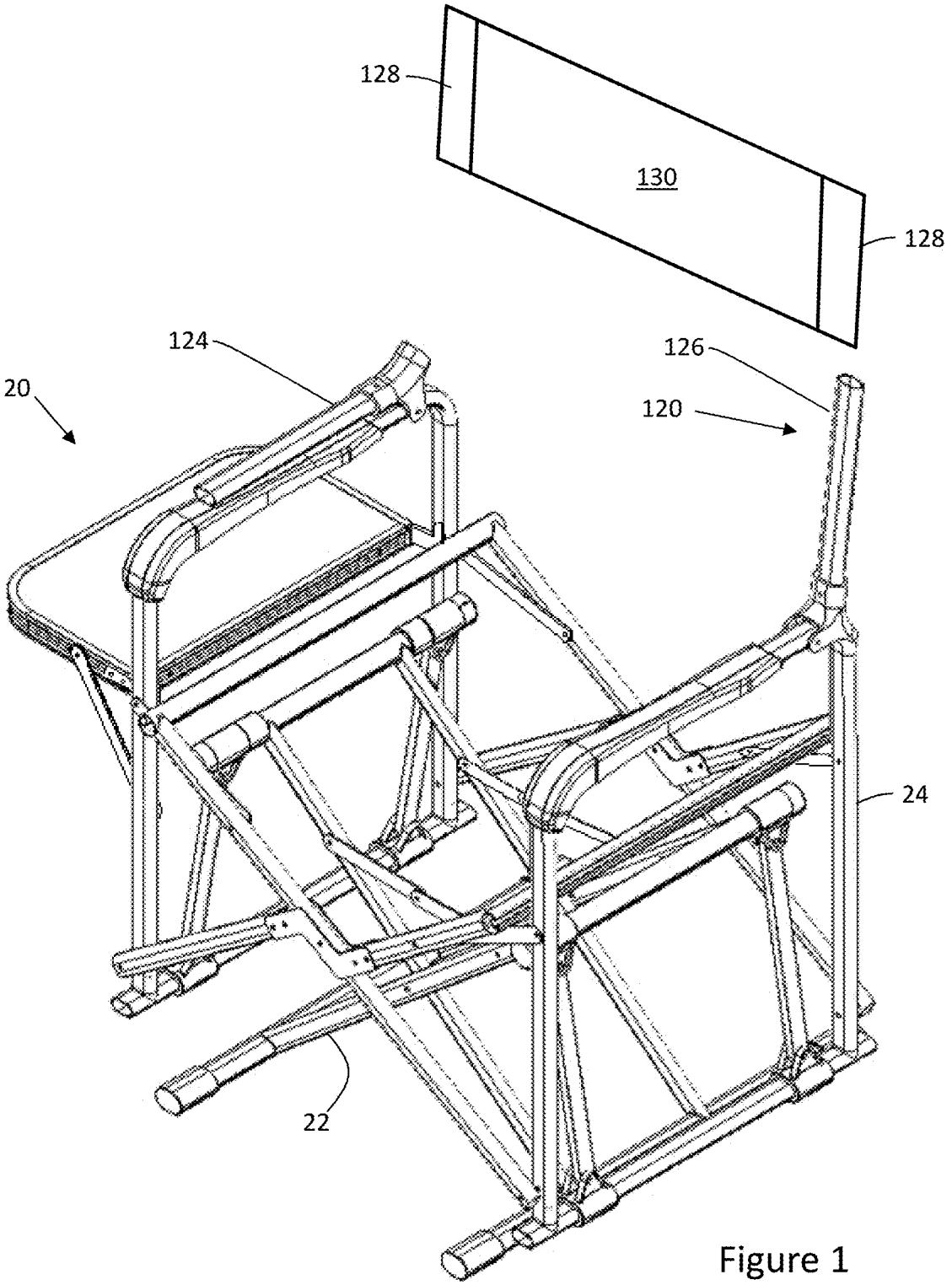
FIG. 1 is a perspective view of an exemplary foldable glider chair.
Figure 2:
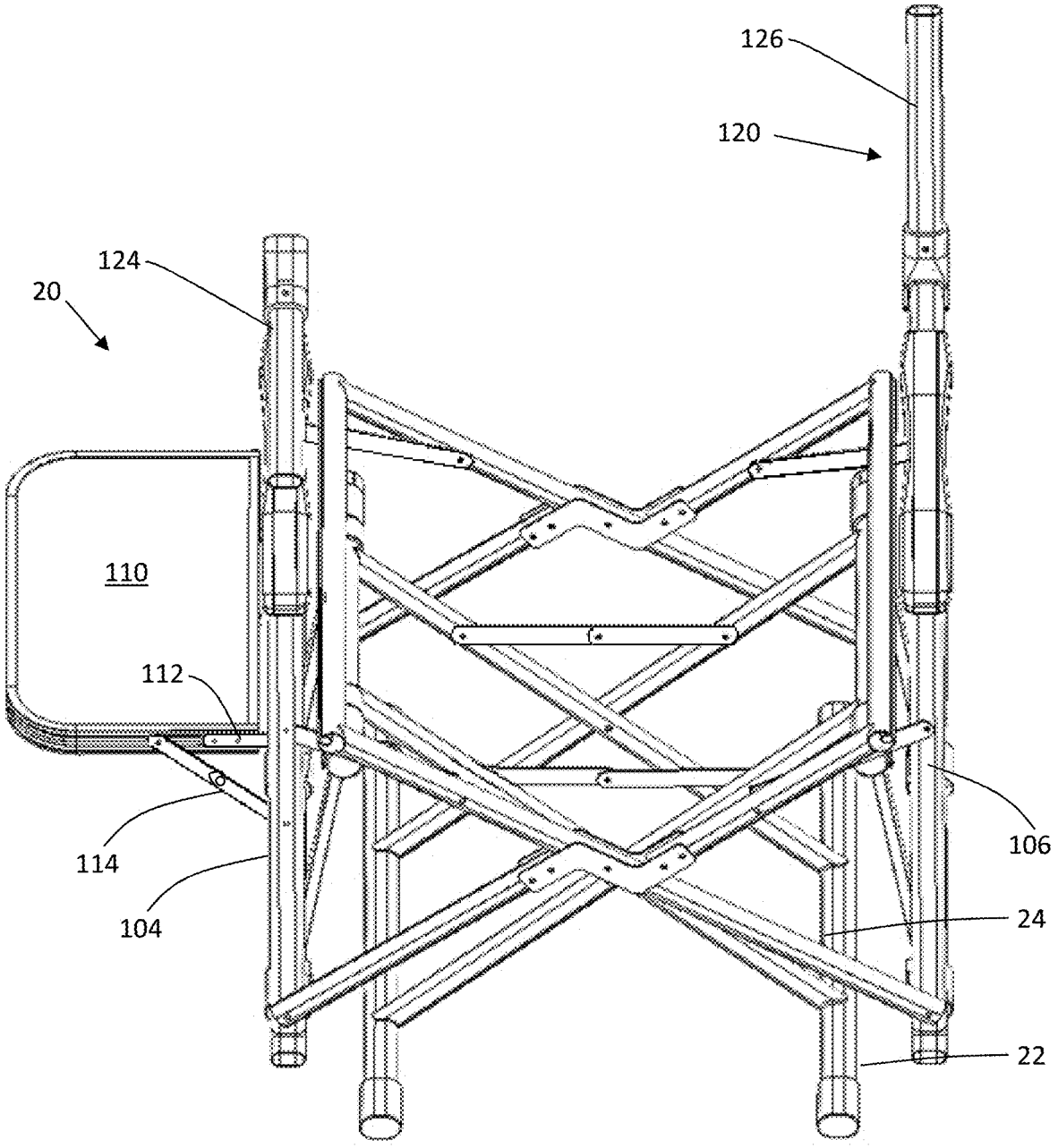
FIG. 2 is an alternate perspective view of the glider chair of FIG. 1.

The gliding chair 20 may have a back rest 120 pivotally connected to the first and second arm rest members 104,106. The back rest 120 may comprise first and second back rest members 122,124 pivotally connected to respective first and second arm rest members 104,106. The first and second back rest members 124,126 may be received into sleeves 128 provided on margins of a pliant material forming the seat back rest 130 (FIG. 1).

One of the first and second front seat supports (e.g., in the drawings the first front seat portion 60) may have an upper portion 140 connected to a lower portion 142 with a front seat plate 144, and the one of the first and second front seat supports may be operatively pivotally connected to the other of the first and second front seat supports at the front seat plate. For instance, as shown in the drawings, the first front seat support 60 has its upper portion 140 connected to its lower portion 142 with the front seat plate 144, and the first front seat support is pivotally connected to the second front seat support 62 the front seat plate. The first front seat support upper portion 140 may be spaced from the lower portion 142 by the front seat plate 144. The second front seat support 62 may pass between the upper and lower portions 140,142 of the first front seat support 60. The front seat plate 144 may include inner and outer portions that are connected to the front face and the rear face of first front seat support upper portion 140 and the first front seat support lower portion 142, respectively. The inner and outer portions of the front seat plate may form a front channel 146 in which the second front seat support 62 passes between the first front seat support upper and lower portions 140,142.

One of the first and second rear seat supports 64,66 (e.g., in the drawings the first rear seat portion 60) may have an upper portion 150 connected to a lower portion 152 with a rear seat plate 154 and the one of the first and second rear seat supports may be operatively pivotally connected to the other of the first and second rear seat supports at the rear seat plate. For instance, as shown in the drawings, the first rear seat support 64 has its upper portion 150 spaced from its lower portion 152 by the rear seat plate 154. The second rear seat support 66 passes between the upper and lower portions 150,152 of the first rear seat support 64. The rear seat plate 154 may include inner and outer portions that are connected to the front face and the rear face of the upper and lower portions 150,152 of the first rear seat support 64. The inner and outer portions of the rear seat plate 154 may form a rear channel 156 in which the second rear seat support 66 passes between the first rear seat support upper and lower portions 150,152.

Further embodiments can be envisioned by one of ordinary skill in the art after reading this disclosure. In other embodiments, combinations or sub-combinations of the above-disclosed invention can be advantageously made. The example arrangements of components are shown for purposes of illustration and it should be understood that combinations, additions, re-arrangements, and the like are contemplated in alternative embodiments of the present invention. Thus, various modifications and changes may be made thereunto without departing from the broader spirit and scope of the invention as set forth in the claims and that the invention is intended to cover all modifications and equivalents within the scope of the following claims.

What is claimed is:

1. A foldable glider chair comprising:

a base comprising:

first and second front leg supports and first and second rear leg supports, the first front leg support being pivotally connected to the second front leg support, the first rear leg support being pivotally connected to the second rear leg support, the first front leg support and the first rear leg support being connected to a first lower leg support, the second front leg support and second rear leg support being connected to a second lower leg support, the first and second lower leg supports being configured to support the glider chair on a support surface, the first front leg support and the first rear leg support being connected to a first upper leg support, the second front leg support and second rear leg support being connected to a second upper leg support, the base being movable between an expanded position and a collapsed position, wherein in the expanded position, the first upper leg support is spaced from the second upper leg support at a first distance, and wherein in the collapsed position the first upper leg support is spaced from the second upper leg support at a second distance, and the first distance is greater than the second distance; and a gliding seat frame comprising:

first and second front seat supports and first and second rear seat supports, the first front seat support being operatively pivotally connected to the second front seat support, the first rear seat support being operatively pivotally connected to the second rear seat support, the first front seat support and the first rear seat support being connected to a first upper seat support, the second front seat support and the second rear seat support being connected to a second upper seat support, the first and second upper seat supports being configured to support a seat of the glider chair, the first front seat support and the first rear seat support being operatively connected to a first lower seat support, the second front seat support and second rear seat support being operatively connected to a second lower seat support, the gliding seat frame being movable between an expanded position and a collapsed position, wherein in the expanded position, the first upper seat support is spaced from the second upper seat support at a third distance, and wherein in the collapsed position, the first upper seat support is spaced from the second upper seat support at a fourth distance, and the third distance is greater than the fourth distance; and further comprising first and second front glide struts and first and second rear glide struts, the first lower seat support being pivotally connected with the first front glide strut and the first rear glide strut, the second lower seat support being pivotally connected to the second front glide strut and the second rear glide strut, the first front glide strut and the first rear glide strut each being pivotally connected to the first upper leg support, the second front glide strut and the second rear glide strut each being operatively pivotally connected to the second upper leg support.

2. The gliding chair of claim 1 wherein the gliding seat frame further comprises first and second arm rest members, the first arm rest member being connected to the first lower seat support, the second arm rest member being connected to the second lower seat support.

3. The gliding chair of claim 2 wherein the first front seat support and the first rear seat support are operatively connected to the first lower seat support through the first arm rest member, and the second front seat support and the second rear seat support are operatively connected to the second lower seat support through the second arm rest member.

4. The gliding chair of claim 2 wherein the first front seat support is connected to the second arm rest member with a first front arm rest support linkage and the second front seat support is connected to the first arm rest member with a second front arm rest support linkage.

5. The gliding chair of claim 2 wherein the first rear seat support is connected to the second arm rest member with a first rear arm rest support linkage and the second rear seat support is connected to the first arm rest member with a second rear arm rest support linkage.

6. The gliding chair of claim 2 further comprising a tray pivotally connected to at least one of the first and second arm rest members.

7. The gliding chair of claim 2 gliding seat frame further comprises a back rest pivotally connected to the first and second arm rest members.

8. The gliding chair of claim 1 wherein the base further comprises a rear over center linkage extending between the first and second rear leg supports.

9. The gliding chair of claim 1 wherein the base further comprises a front over center linkage extending between the first and second front leg supports.

10. The gliding chair of claim 1 wherein one of the first and second front seat supports has an upper portion connected to a lower portion with a front seat plate and the one of the first and second front seat supports is operatively pivotally connected to the other of the first and second front seat supports at the front seat plate.

11. The gliding chair of claim 10 wherein the one of the first and second front seat supports upper portion is spaced from the lower portion by the front seat plate, and the other of the first and second front seat supports passes between the one of the first and second front seat supports upper and lower portions.

12. The gliding chair of claim 1 wherein one of the first and second rear seat supports has an upper portion connected to a lower portion with a rear seat plate and the one of the first and second rear seat supports is operatively pivotally connected to the other of the first and second rear seat supports at the rear seat plate.

13. The gliding chair of claim 12 wherein the one of the first and second rear seat supports upper portion is spaced from the lower portion by the rear seat plate, and the other of the first and second rear seat supports passes between the one of the first and second rear seat supports upper and lower portions.

14. A foldable glider chair comprising:

a base comprising:

front cross leg supports and rear cross leg supports, the front cross leg supports being spaced from the rear cross supports by first and second lower leg supports and first and second upper leg supports, the front cross leg supports and the rear cross legs supports being movable between an expanded position and a collapsed position, wherein in the expanded position, the first lower leg support is spaced from the second lower leg support at a first distance, and wherein in the collapsed position the first lower leg support is spaced from the second lower leg support at a second distance, the second distance being less than the first distance;

a gliding seat frame comprising:

front cross seat supports and rear cross seat supports, the front cross seat supports being spaced from the rear cross supports by first and second lower seat supports and first and second upper seat supports, the front cross seat supports and the rear cross seat supports being movable between an expanded position and a collapsed position, wherein in the expanded position, the first lower seat support is spaced from the second lower leg support at a third distance, and wherein in the collapsed position the first lower seat support is spaced from the second lower seat support at a fourth distance, the fourth distance being less than the third distance;

wherein the first lower seat support is operatively pivotally connected with the first upper leg support and the second lower seat support is operatively pivotally connected with the second upper leg support.

15. The gliding chair of claim 14, wherein the gliding seat frame further comprises first and second glide struts, the first glide strut being operatively pivotally connected with the first lower seat support and the first upper leg support, the second glide strut being operatively pivotally connected with the second lower seat support and the second upper leg support.

16. The gliding chair of claim 15 wherein the gliding seat frame further comprises third and fourth glide struts, the third glide strut being operatively pivotally connected with the first lower seat support and the first upper leg support, the fourth glide strut being operatively pivotally connected with the second lower seat support and the second upper leg support.

17. The gliding chair of claim 14 wherein the front cross leg supports comprise first and second front leg supports pivotally connected to each other.

18. The gliding chair of claim 17 further comprising a front over center linkage extending between the first and second front leg supports.

19. The gliding chair of claim 14 wherein the rear cross leg supports comprise first and second rear leg supports pivotally connected to each other.

20. The gliding chair of claim 19 further comprising a rear over center linkage extending between the first and second rear leg supports.

21. The gliding chair of claim 14 wherein the front cross seat supports comprise first and second front seat supports pivotally connected to each other.

22. The gliding chair of claim 21 wherein one of the first and second front seat supports has an upper portion connected to a lower portion with a front seat plate and the one of the first and second front seat supports is operatively pivotally connected to the other of the first and second front seat supports at the front seat plate.

23. The gliding chair of claim 22 wherein the one of the first and second front seat supports upper portion is spaced from the lower portion by the front seat plate, and the other of the first and second front seat supports passes between the one of the first and second front seat supports upper and lower portions.

24. The gliding chair of claim 14 wherein the rear cross seat supports comprise first and second rear seat supports pivotally connected to each other.

25. The gliding chair of claim 24 wherein one of the first and second rear seat supports has an upper portion connected to a lower portion with a rear seat plate and the one of the first and second rear seat supports is operatively pivotally connected to the other of the first and second rear seat supports at the rear seat plate.

26. The gliding chair of claim 25 wherein the one of the first and second rear seat supports upper portion is spaced from the lower portion by the rear seat plate, and the other of the first and second rear seat supports passes between the one of the first and second rear seat supports upper and lower portions.

* * * * *